US006741177B2

(12) United States Patent
Ballantyne

(10) Patent No.: US 6,741,177 B2
(45) Date of Patent: May 25, 2004

(54) METHOD AND APPARATUS FOR DETECTING ITEMS ON THE BOTTOM TRAY OF A CART

(75) Inventor: William John Ballantyne, Aurora (CA)

(73) Assignee: VerifEye Inc., Ontario (CA)

( * ) Notice: Subject to any disclaimer, the term of this patent is extended or adjusted under 35 U.S.C. 154(b) by 105 days.

(21) Appl. No.: 10/109,552

(22) Filed: Mar. 28, 2002

(65) Prior Publication Data

US 2003/0184440 A1 Oct. 2, 2003

(51) Int. Cl.[7] ..... G08B 13/14
(52) U.S. Cl. ..... 340/568.5; 340/556; 340/557
(58) Field of Search ..... 340/568.5, 555, 340/556, 557; 250/222.1

(56) References Cited

U.S. PATENT DOCUMENTS

| | | | | |
|---|---|---|---|---|
| 3,457,423 A | | 7/1969 | Gravely | 250/223 |
| 3,725,894 A | | 4/1973 | Geisler | 340/280 |
| 4,237,483 A | | 12/1980 | Clever | 358/108 |
| 4,327,819 A | | 5/1982 | Coutta | 186/62 |
| 4,338,594 A | | 7/1982 | Holm | 340/568 |
| 4,723,118 A | | 2/1988 | Hooley et al. | 340/568 |
| 4,725,822 A | * | 2/1988 | Hooley | 340/568.5 |
| 4,736,098 A | * | 4/1988 | Rehrig | 250/222.1 |
| 4,979,815 A | | 12/1990 | Tsikos | 356/1 |
| 5,485,006 A | | 1/1996 | Allen et al. | 250/222.1 |
| 5,495,102 A | | 2/1996 | Fine | 250/222.1 |
| 5,500,526 A | | 3/1996 | Shalvi et al. | 250/222.1 |
| 5,610,584 A | | 3/1997 | Schrade | 340/568 |
| 5,883,968 A | | 3/1999 | Welch et al. | 382/100 |
| 5,910,769 A | | 6/1999 | Geisler | 340/568.5 |
| 6,201,473 B1 | * | 3/2001 | Schaffer | 340/568.5 |
| 6,362,728 B1 | | 3/2002 | Lace et al. | 340/426 |
| 6,542,079 B1 | * | 4/2003 | Kahl, Sr. | 340/568.5 |

FOREIGN PATENT DOCUMENTS

| | | | |
|---|---|---|---|
| DE | 32 17 944 A1 | 11/1993 | A47F/9/04 |
| EP | 0 629 370 A1 | 12/1994 | A47F/9/04 |
| WO | WO 94/17700 | 8/1994 | A47F/9/04 |
| WO | WO 97/29450 | 8/1997 | G06K/9/00 |

OTHER PUBLICATIONS

GB Search Report for GB 0307133.9.

* cited by examiner

*Primary Examiner*—Thomas J Mullen, Jr.
(74) *Attorney, Agent, or Firm*—Kilyk & Bowersox P.L.L.C.

(57) ABSTRACT

An apparatus is provided for detecting a shopping cart used to bring items to a checkout location, and inspecting its bottom tray for the presence of items. The apparatus includes a cart-detector to detect the presence of the cart at a pre-determined location; and an item-detector to detect the presence of items placed on the lower tray of the cart. The cart detector includes an arrangement of three optical sensors and corresponding retro-reflective targets; and finite state-machine processing logic to discriminate a specific sequence of sensor responses. The item detector includes an optical line generator to project a structured illumination pattern on any items placed on the lower tray of the shopping cart as well as on the opposite wall of the checkout lane; an area-imaging sensor and associated optics and digitizing means to capture the reflected pattern in digital form; a pattern-analysis means to analyze the captured pattern; and a means for transmitting the result of the pattern analysis, for example, to a system that can alert the attendant and/or the customer, or to a means that prevents further progress of the car through the checkout lane.

25 Claims, 7 Drawing Sheets

METHOD AND APPARATUS FOR DETECTING ITEMS ON THE BOTTOM TRAY OF A CART

FIELD OF THE INVENTION

The invention relates to electronic surveillance systems for loss-prevention and security, and in particular, to a detection method and apparatus used in a retail store for automatically determining if a shopping cart, passing through a check-out aisle, contains items on its bottom or lower tray. The invention automates a task that is typically required of a human check-out attendant. The invention may be used in a variety of ways, for example, to direct a visible or audible message to the cashier and/or customer, or to trigger a second system to physically prevent further movement of the cart through the check-out lane.

BACKGROUND OF THE INVENTION

Shopping carts, as used in supermarkets, for example, often include a bottom tray below the main storage basket for carrying additional items. The bottom tray is a convenience for the customer, and increases the cawing capacity of the carts. However, due to the obscuring presence of the check-out desk, goods carried on the bottom tray tend not to enter the check-out attendant's lines of sight for long, if at all, and consequently may leave the store unnoticed and unpaid for.

A variety of devices exist to assist check-out attendants in noticing the presence of goods on the bottom tray of the shopping cart. The most common are mirrors positioned so as to afford the attendant an improved view of the lower cart region for at least a short period of time. However, this approach requires the attendant to look at the proper moment, which is not always practical.

A number of devices that automatically detect a shopping cart and indicate the presence of objects on the bottom tray when it passes a fixed location are described in the prior art.

U.S. Pat. Nos. 4,327,819 and 4,723,118 describe detection means responsive to the weight of objects placed on the bottom tray of the cart.

U.S. Pat. Nos. 3,457,423, 3,725,894, 4,338,594, 5,485,0, 06, 5,495,102, 5,610,584, 5,500,526, and 5,910,769 describe detection approaches based on various arrangements of discrete phototransmitters, photoreceivers, retroreflective markers, and processing logic for signal sequence recognition and time-delay gating. The basis of all of these approaches is to discriminate the presence of a shopping cart (as opposed to any other passing object) and then to check for the presence of an item on the bottom tray. The cart-detection function in some of these approaches involves the detection of a special tag affixed to the cart, or in others the statically coded combination of a plurality of discrete sensor outputs. The item detection in each of these approaches is either inferred from the blocking of an optical signal, or the backscattered reflection of an optical signal.

U.S. Pat. Nos. 4,237,483 and 5,883,968 describe devices that employ imaging and automated image analysis to detect the presence and type of goods on the bottom tray. In particular, U.S. Pat. No. 5,883,968 describes the use of a digital image analysis technique whereby a reference image of an empty cart is compared to acquired images. It also describes the use of color-discriminating and Identification Code discriminating techniques.

The performance of any detection system may be quantified statistically in terms of its False Detection Rate (FDR), which is the percentage of false detection instances recorded in a statistically significant population of trials. False detection rates can be sub-divided into the "false-positive" and "false-negative" type. None of the systems described in the prior art are likely to exhibit zero FDR, because of assumptions and approximations they each make relating to such factors as cart geometry and motion, optical and geometric properties of the items to be detected.

For example, all of the cited prior art that employ discrete, narrow-field photo-detectors depend on uninterrupted cart motion past the sensor array to provide sufficient continuity (coverage) in the scanning phase of the item-detection. However, in practice, shopping carts can and do pause for varying periods of time, and sometimes even reverse direction temporarily before proceeding through the checkout.

The apparatus described in U.S. Pat. No. 5,883,968 employs a two-dimensional imaging sensor (digital camera), which affords an instantaneous view of the whole under cart area thereby providing an advantage over narrow-field photo-detectors. However, the accuracy of the item-detection is adversely impacted by a number of factors including variability of lighting conditions and variability of the proximity of the cart to the camera lens. This latter issue is particularly acute due to the practical necessity of wide-angle lens optics, which suffer from exaggerated perspective distortion. Moreover, automated image analysis algorithms typically require considerably more processing power than the simple logic processing used with discrete photo-detector solutions, thereby increasing the cost of a product.

A means of improving the ability of two-dimensional imaging sensors to discriminate the shape and position of objects in three-dimensional space through the use of structured illumination is taught in U.S. Pat. No. 4,979,815.

The present invention improves on the prior art, by improving the performance of both the cart-detection function and the item-detection function. The former is accomplished without the use of special cart-affixed tags or error-prone static logic, and the latter is achieved through the use of structured illumination imaging and pattern analysis.

The disclosures of all patents/applications referenced in this specification are hereby incorporated herein by reference in their entirety.

SUMMARY OF THE INVENTION

In a preferred embodiment of the present invention there is provided an apparatus for detecting a shopping cart used to bring items to a checkout location, and inspecting its bottom tray for the presence of items, the apparatus comprising:

a. a cart-detector to detect the presence of the cart at a pre-determined location; and b. an item-detector to detect the presence of items placed on the lower tray of the cart.

The cart detector is comprised of:

a. an arrangement of three optical sensors and corresponding retro-reflective targets; and b. finite state-machine processing logic to discriminate a specific sequence of sensor responses.

The item detector is comprised of:

a. an optical line generator to project a structured illumination pattern on any items placed on the lower tray of the shopping cart as well as on the opposite wall of the checkout lane;

b. an area-imaging sensor and associated optics and digitizing means to capture the reflected pattern in digital form;

c. a pattern-analysis means to analyze the captured pattern; and d. a means for transmitting the result of the pattern analysis, for example, to a system that can alert the attendant and/or the customer, or to a means that prevents further progress of the car through the check-out lane.

Therefore, in accordance with one aspect of the present invention, there is provided an apparatus for detecting a cart used to bring items to a checkout location, and for detecting an item on a bottom tray of the cart, the apparatus comprising:

a. a cart detector for detecting the cart and discriminating between the cart and other objects, the cart detector comprising:
   i. a plurality of optical sensors operatively arranged within the checkout location to detect predetermined parts of the art and to produce output signals dependent on the detected predetermined parts, and
   ii. electronic logic for decoding the output signals and generating an activator signal;

b. an item detector, which when activated by the activator signals, detects the item on the bottom tray and transmits an alarm signal, the item detector comprising:
   i. an optical line generator and an imager that generate a digital image corresponding to the item detected; and
   ii. a pattern-recognition means to process and analyze the digital image and generate the alarm signal when the item is detected.

In accordance with a second aspect of the present invention, there is provided a method of detecting a cart used to bring items to a checkout location, and an item on a bottom tray of the cart, the method comprising the steps of:

a. operatively arranging a plurality of optical sensors within the checkout location;

b. detecting predetermined parts of the cart with the optical sensors and producing output signals dependent on the detected predetermined parts;

c. decoding the output signals using electronic logic and generating an activator signal to activate an item detector that comprises an optical line generator, an imager and a pattern-recognition means;

d. generating a digital image corresponding to the item detected on the bottom tray; and e. processing and analyzing the digital image and generating the alarm signal when the item is detected.

BRIEF DESCRIPTION OF THE DRAWINGS

The preferred embodiments of the present invention will be described with reference to the accompanying drawings in which like numerals refer to the same parts in the several views and in which.

DETAILED DESCRIPTION OF THE PREFERRED EMBODIMENTS

The preferred embodiments of the present invention will now be described with reference to the accompanying figures.

Figure 1:
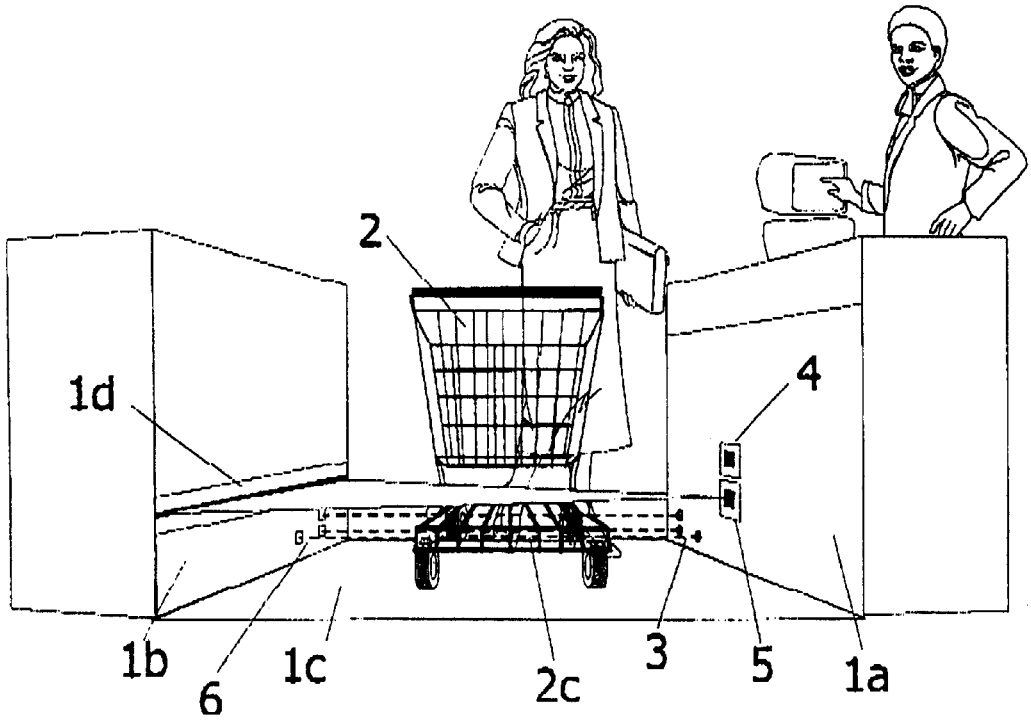
FIG. 1 is a pictorial perspective of a preferred embodiment of the present invention showing the physical arrangement of the checkout aisle.

FIG. 1 illustrates a preferred embodiment of the present invention as arranged in a typical checkout aisle of a store. The aisle includes a counter wall 1*a*, opposing wall 1*b* and floor 1*c*. A shopping cart 2 having a bottom tray 2*c* is moved by the customer along floor 1*c* between walls 1*a* and 1*b*. Cart-detector sensor cluster 3, an imager 4 and optical line generator 5 are all located on counter wall 1*a*, whereas retro-reflective targets 6 are disposed on the opposing wall 1*b*.

Figure 2:
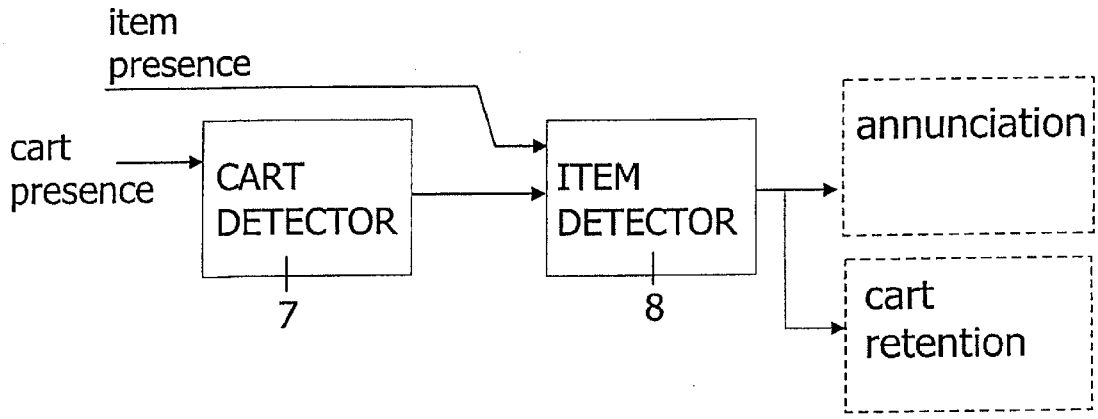
FIG. 2 is a top-level system block diagram showing the relationship between the cart-detector, the item-detector, the external events and conditions that provide input to the system.

As shown in the top-level system diagram of FIG. 2, the present invention is comprised of two sub-systems: the cart-detector 7 and the item-detector 8.

The purpose of the cart-detector 7 is to reliably detect the presence of the shopping cart 2 at a pre-determined location as it passes through the check-out aisle between counter wall 1*a* and opposing wall 1*b*. An important aim of the cart-detector 7 sub-system is to minimize false detection, that is, detection of other objects such as human legs, and baby strollers that would commonly pass through the check-out aisle.

The purpose of the item-detector 8 is, when activated by the cart-detector 7, to reliably determine if the bottom tray 2*c* of the shopping cart 2 contains any items.

Figure 3:
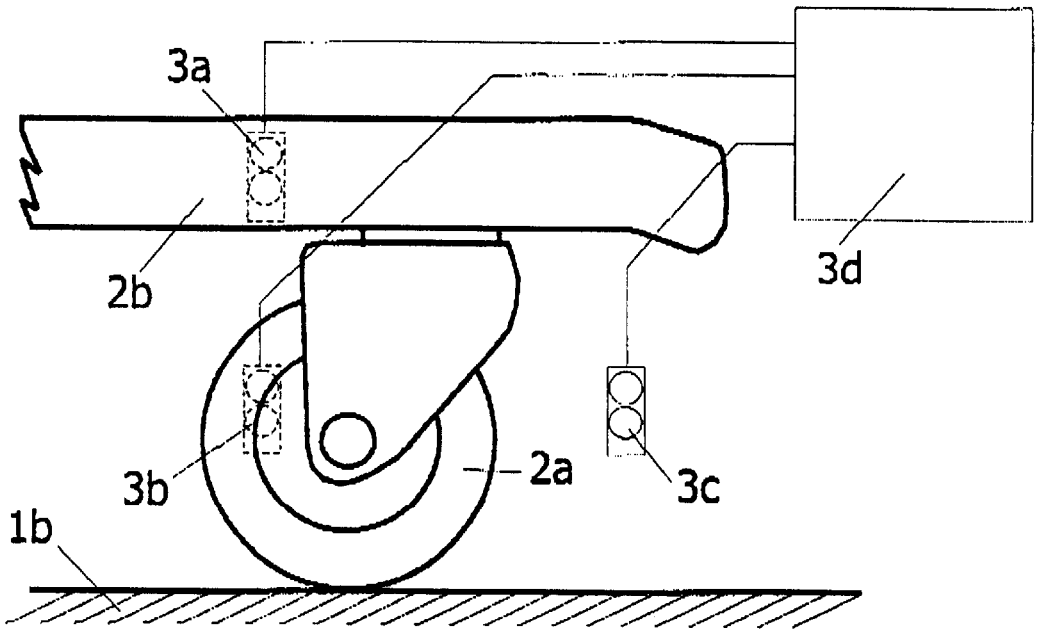
FIG. 3 is a physical diagram showing the relative positioning of the cart-detector sensor cluster to the cart wheel and chassis side-frame structures.

As better seen in FIG. 3, the cart-detector 7 is comprised of a sensor cluster 3, which in this embodiment includes three optical sensors 3*a*, 3*b*, 3*c*, and electronic logic 3*d* for decoding the particular sequence of sensor responses that is produced in this cluster 3 by a passing shopping cart 2. The preferred embodiment of the present invention employs so-called "reflex" type sensors as the optical sensors 3*a*, 3*b* and 3*c*, which collocate the optical emitter and receiver in a common module, but require a separate, passive retro-reflective target 6 located an the opposing wall 1*b*. Alternately, separate well known emitter and receiver pairs can be used. In either case, the optical sensors 3*a*, 3*b*, and 3*c* are arranged in such a way that they are responsive to a light beam interruption.

The general geometric arrangement of the cart-detector sensor cluster 3 and retro-reflective targets 6 with respect to the checkout lane is shown in FIG. 1. A more detailed view, showing the positions of the three sensors 3*a*, 3*b* and 3*c* relative to the check-out aisle floor 1*c* and the relevant structural elements of the shopping cart 2 is shown in FIG. 3.

The sequence of sensor responses generated by a passing shopping cart 2 may be understood by reference to FIG. 4*a* through FIG. 4*e*. Note that the relevant structural elements of the shopping cart 2 involved in interrupting the three light beams corresponding to each of the three sensors 3*a*, 3*b* and 3*c* are the cart frame side rail 2*a* and the cart front wheel 2*b*.

Figure 5:
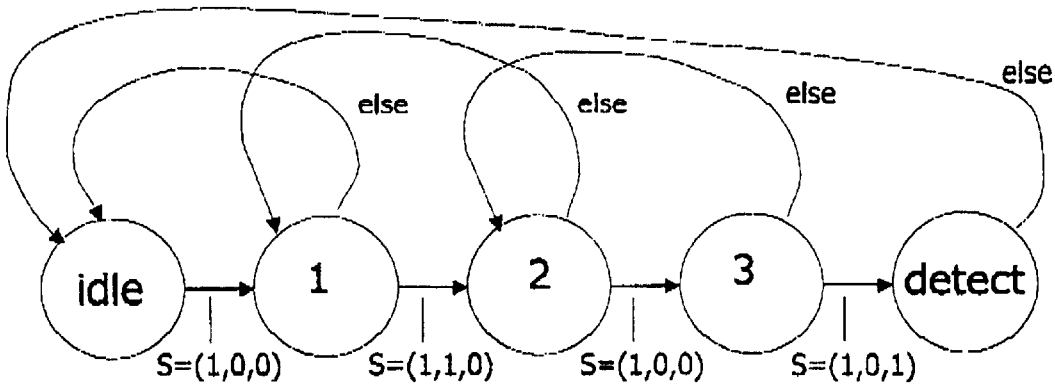
FIG. 5 is a state transition diagram showing the logic of the cart detector finite state machine.

A state-transition diagram, indicating the logical processing of the signal received from the three sensors 3*a*, 3*b* and 3*c* is shown in FIG. 5. This diagram represents the function of the cart-detector finite state machine (FSM), which in the preferred embodiment is implemented in a Field Programmable Gate Array (FPGA). Finite state machines are logical processing constructs well known to those skilled in the art of FPGA applications-design. Note that in a state-transition diagram, such as FIG. 5, every bubble represents a "state" of the logic system. It is only possible to transition from one state to another if the conditions indicated on the connecting arrow are true. The use of an FSM ensures that the cart-detector 7 is only responsive to a specific sequential ordering of the inputs, and that all other possible combinations are explicitly handled as "exceptions". Moreover, the geometry and placement of the cart-detector sensor cluster 3 is designed to respond to the sequence of sensor inputs resulting from the geometry and movement of the passing shopping cart 2, but not to other passing objects. To achieve this, the design of the cart-detector 7 takes advantage of two geometric features that are common to most shopping cart designs: the presence of the wheel 2*a* near the floor, and the presence of the horizontal chassis side-rail 2*b* just above this wheel 2*a*.

Figure 4A:
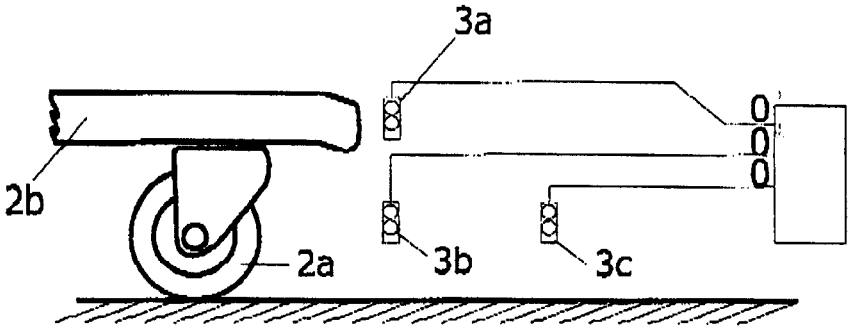
FIGS. 4*a* to 4*e* show the characteristic sequence of sensor responses as the cart moves past the cart-detector sensor cluster.
Figure 4B:
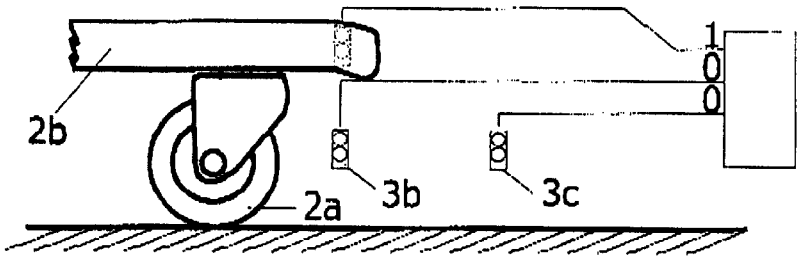
Figure 4C:
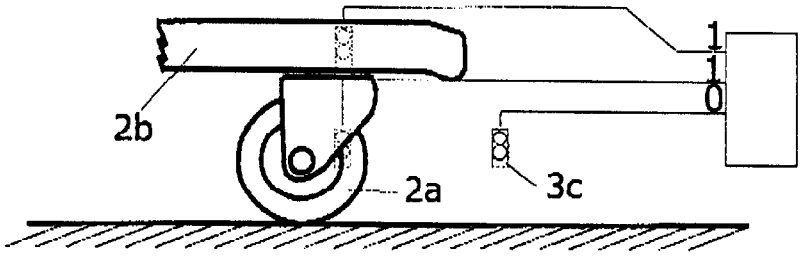
Figure 4D:
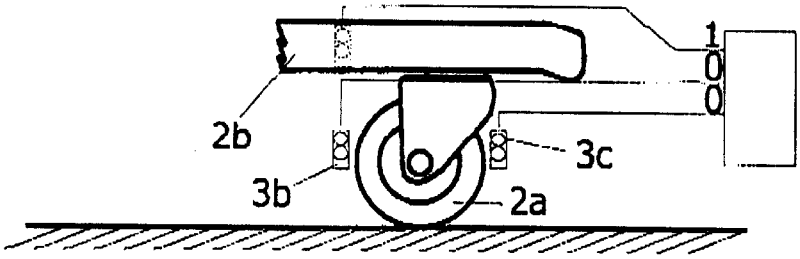
Figure 4E:
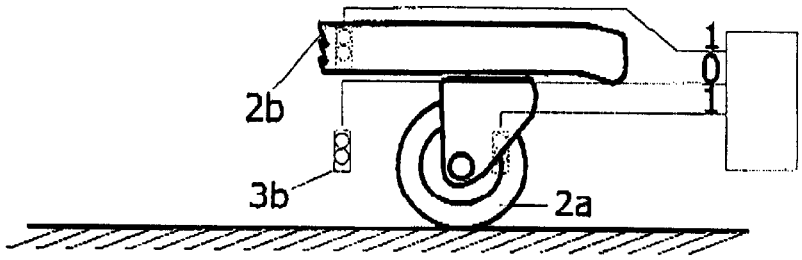

The nominal operation of the cart-detector FSM may be understood by considering the case of the shopping cart 2 moving past the cart-detector sensor cluster 3 with a uniform velocity. Consider that the combined cluster of three sensors 3*a*, 3*b*, 3*c* produce an output signal S=(a,b,c). At any particular instant the values of each of the three components, a,b,c may be either 1 or 0 depending on the position of the shopping cart 2, that is, whether the wheel 2*a* and/or chassis side-rail 2*b* block a particular sensor. For example, prior to the time the shopping cart 2 enters the proximity of the sensor cluster 3, the FSM state is "idle", and the value of S=(0,0,0). As the cart progresses in its movement, the chassis side-rail interferes with sensor 3*a* creating the value S=(1,0,0), causing an FSM transition to state "1". This is shown in FIG. 4*b*. FIG. 4*c* shows the case when the shopping cart 2 moves further along, so that the wheel 2*a* blocks sensor 3*b*, and sensor 3*a* continues to be blocked by the chassis side rail 2*b*, creating the sensor value S=(1,1,0) and an FSM transition to state "2". Next, in FIG. 4*d* the wheel 2*a* moves to a position where it is between sensors 3*b* and 3*c* and therefore blocks neither, resulting in the value S=(1,0,0) and an FSM transition to state "3". It is to be noted, therefore, that sensors 3*b* and 3*c* should be spaced apart sufficiently to allow wheel 2*a* to fit between sensors 3*b* and 3*c*. As the cart 2 advances to the point where sensor 3*c* is blocked in addition to sensor 3*a* and the value of S=(1,0,1) resulting in an FSM transition to the "Detect" state (FIG. 4*e*).

Other cases that are handled by the cart-detector FSM include the cases where the shopping cart 2 motion stops for a period of time before recommencing motion, and the cases where the shopping cart 2 changes its direction temporarily before finally completing its passage. The latter cases produce signals that are recognized by the FSM as being different from the nominal signal, resulting in a reversion to an earlier, appropriate state, from which the sequence can resume.

Once a valid cart-detection occurs, that is, the sequences shown in FIGS. 4*a* to 4*e* and 5 are completed, the item-detector 8 is activated by a signal to check for the presence of an item 9 on the bottom tray 2*c* of the cart 2. The item-detector 8 employs the electronic optical line generator 5 and the item-detector imager 4 to generate a digital image of the reflected light pattern. The digital image is processed and analyzed by a pattern-recognition algorithm 8, and a determination is made as to the presence or absence of the item 9 on the bottom tray 20.

A preferred feature of the item-detector 8 is the use of structured illumination. The term "structured" refers to the fact that the direction, shape, temporality, and wavelength of the projected light energy is controlled and known. In particular, the preferred embodiment of the present invention employs a wide fan-angle, flat-beam, projecting laser (also known as a "laser line-generator module"), which is positioned such that the projected light plane extends parallel to the floor 1*c* at a height just above the top of the shopping cart chassis side-rail 2*b*. The laser light is controlled "on" or "off" according to certain conditions that are described below. The wavelength of the laser light is preferably in a narrow band around 780 nm (near infra-red).

Figure 6:
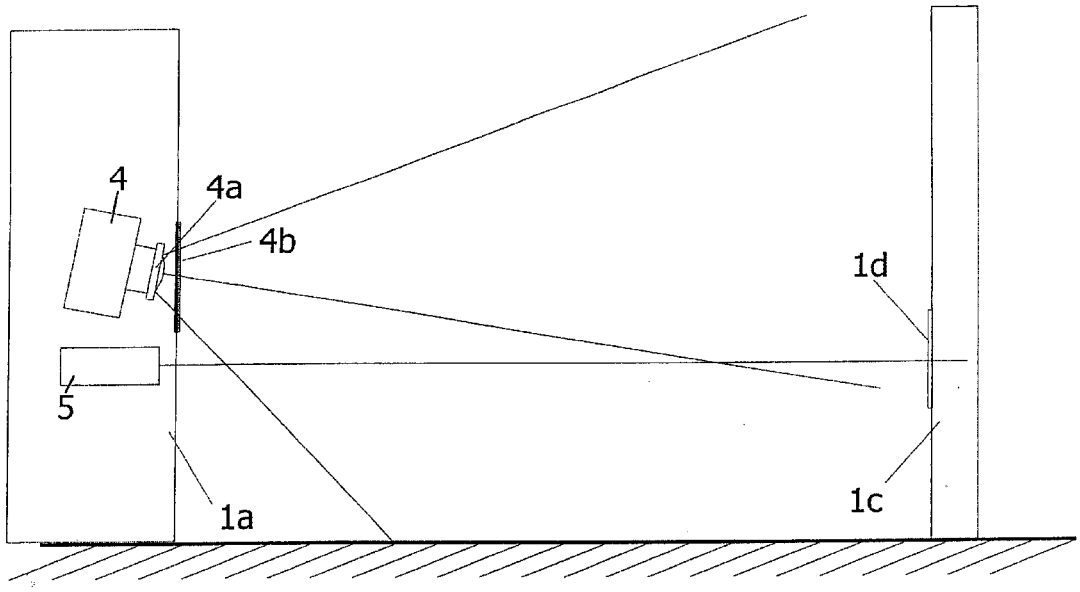
FIG. 6 is a physical diagram showing the relationship between the projecting laser and imager with respect to the checkout aisle.

Another preferred feature of the item-detector 8 is the structure of the item-detector imager 4. The optical axis of the imager lens 4*a* is offset and angled with respect to the laser projection axis as indicated in FIG. 6. Specifically, in the preferred embodiment, the imager 4 is positioned a distance of a few centimeters above the laser projector axis and angled downward such that their axes intersect at a distance of a few tons of centimeters away. This offset configuration of imager 4 and projecting laser produces an effect well known to those skilled in the art of optical systems applications design as "parallax". A property of parallax is that as the distance between the imager 4 and a particular object in the viewed scene decreases, the corresponding image of the object appears closer to the bottom of the field of view.

Figure 7A:
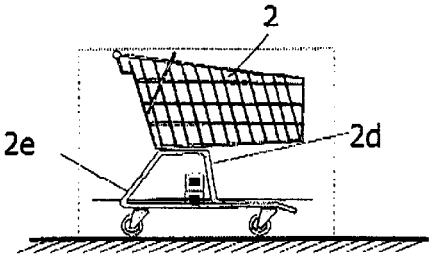
FIGS. 7*a* to 7*f* are physical diagrams of the shopping cart in the position where the item detector is active, showing the item-detector pattern image for the condition when there is no item and for the condition where an item is present on the bottom tray.
Figure 7B:
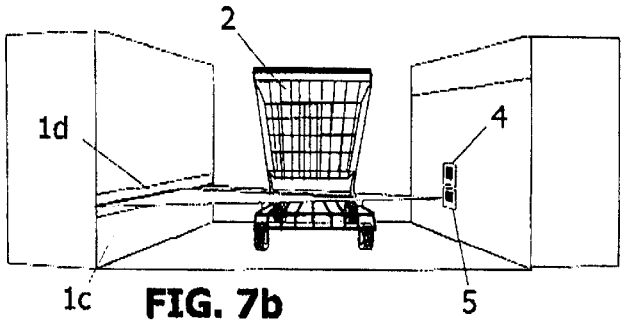
Figure 7C:
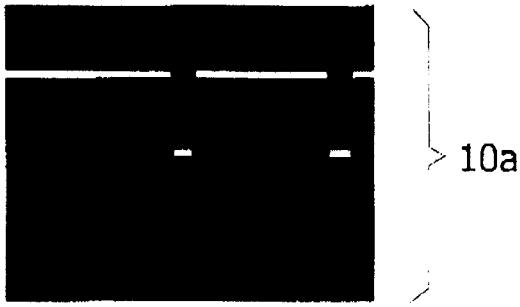
Figure 7D:
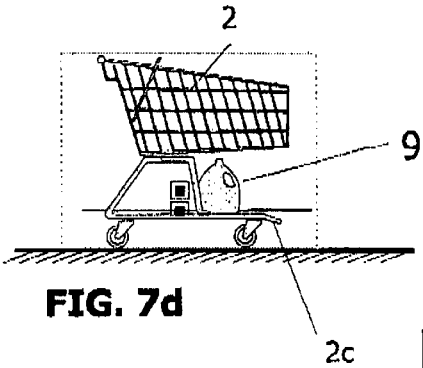
Figure 7E:
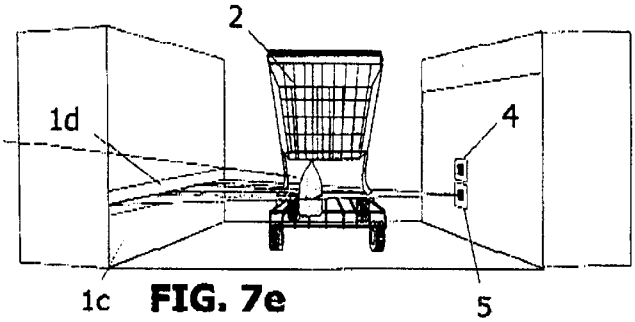

The operation of the item-detector 8 will now be described with reference to FIGS. 7*a* to 7*f*. In FIGS. 7*a* to 7*c*, an empty shopping cart 2 is shown in the checkout aisle at the location where the item-detector 8 would be invoked. The pattern 10*a* captured by the imager 4 is predominantly correspondent to the projected laser stripe reflected from the opposite wall 11*b*, with a few relatively short "space" and "mark" features corresponding to the interfering presence of the fore 2*d* and aft 2*e* basket support stanchions of the cart 2. This pattern represents the "baseline" pattern, In FIGS. 7*d* to 7*f*, the shopping cart 2 is again shown in the same position, but with the item 9 on its bottom tray 2*c*. The pattern 10*b* that is captured in this case exhibits a more pronounced gap in the top horizontal line, and a corresponding line segment below the region of the gap. The gap corresponds to the shadow cast on the opposite wall 11*b* by the interference of the item 9 with the projecting laser from optical line generator 5. The long line segment corresponds to the image of the reflected laser striking the surface of the item 9.

The above example illustrates how the presence of the item 9 on the bottom tray 2*c* produces changes to the baseline pattern captured by the imager 4. Moreover, the example suggests two means of detecting the item 9. The first means is to measure the degree to which the upper horizontal line includes gaps. When the degree of gap inclusion exceeds the baseline amount, the presence of the item 9 is inferred. The second means is to measure the degree to which line segments appear in the regions located below the predominant stripe in the baseline pattern. When the degree of line segment inclusion increases beyond the baseline amount, the presence of an item is inferred. Either or both of these means may be used. In fact, combining both means can increase the reliability of the detection. Note that the length, location and number of gaps and line segments in the pattern image may be determined using straightforward digital techniques that operate on the pixel array collected by the imager 4.

Figure 7F:
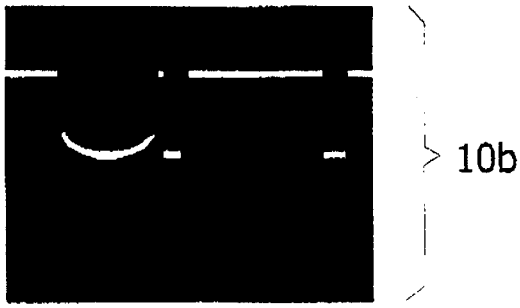

The example pattern images 10*a*, 10*b* shown in FIG. 7*c* and 7*f* are preferred in two respects: First, the pattern images are "binary" images, that is, they consist of only black or white pixels (no grey). Second, they contain features that result from the projected laser illumination and not from any other uncontrolled illumination source. In practice, the raw images contain a range of grey levels (not just black and white) and uncontrolled, ambient light falling on the scene will tend to produce unwanted artefacts in the pattern image. In this sense, ambient lighting is considered "noise" and must be removed from the signal to the greatest practical extent. Once all the noise is eliminated from the pattern image, a threshold comparison operation is performed on each pixel to produce a binary image. Following these steps, the image may be analyzed to detect the presence of an item.

In the preferred embodiment, four separate measures are used to improve the signal to noise ratio so as to produce a useful pattern image. The first measure is to employ an optical filter 4*b* to filter all the light entering the imager lens 4*a* thereby allowing only the wavelength of the projected laser to pass. This measure will attenuate a large portion of the ambient light received by the imager 4. The second measure is to employ a strip of retro-reflective material 1*d* on the opposite wall surface 1*b*, which causes the projected laser light that is reflected back to the imager lens 4*a* to be stronger, relative to the ambient light signal, than it would be if the surface were simply diffuse. The third measure is to capture not just one, but a pair of images, closely spaced in time, whereby the first image of the pair is made while the projected laser is enabled, and the second image is made while the projected laser is inhibited. Subtracting these two images produces a "difference image", which substantially rejects the effect of ambient lighting that is common to both images. In a most preferred embodiment, the image pair is captured with 1/30 of a second interval between the first and second image of the pair, corresponding to the frame repetition rate of a standard video signal. The fourth measure is to process the difference image with a minimum line-thickness filter. This filter rejects bright features that occupy fewer than a preset number of vertically-adjacent or horizontally-adjacent connected pixels. This method is effective at removing minor artefacts that develop in the difference image due to any temporal changes in the scene that occur in the short time interval between the first image and second image of the pair.

Once an item is detected on the bottom tray of a shopping cart, an alarm signal is generated. The alarm signal may be used in known ways to generate a visible or audible message to the cashier and/or customer. Also, the alarm signal may be used to trigger a second system to physically prevent further movement of the cart through the check-out lane. Such a second system is disclosed in U. S. Pat. No. 6,362,728 issued Mar. 26, 2002 to Lace et al, which is incorporated herein by reference.

Although the present invention has been shown and described with respect to its preferred embodiments and in the examples, it will be understood by those skilled in the art that other changes, modifications, additions and omissions may be made without departing from the substance and the scope of the present invention as defined by the attached claims.

What is claimed is:

1. An apparatus for detecting a cart used to bring items to a checkout location, and for detecting an item on a bottom tray of the cart, the apparatus comprising:

(a) a cart detector for detecting the cart and discriminating between the cart and other objects, the cart detector comprising:
  (i) a plurality of optical sensors operatively arranged within the checkout location to detect predetermined parts of the cart and to produce output signals dependent on the detected predetermined parts; and
  (ii) electronic logic for decoding the output signals and generating an activator signal;

(b) an item detector, which when activated by the activator signal, detects the item on the bottom tray and transmits an alarm signal, the item detector comprising:
  (i) an optical line generator and an imager that generate a digital image corresponding to the item detected; and
  (ii) a pattern-recognition means to process and analyze the digital image and generate the alarm signal when the item is detected.

2. The apparatus of claim 1, comprising at least three optical sensors and wherein the electronic logic is finite state machine logic.

3. The apparatus of claim 2, wherein the optical sensors are reflex type sensors that each combine an emitter and a receiver within a same module, and the apparatus further comprises a passive retro-reflective target operatively arranged within the checkout location.

4. The apparatus of claim 2, wherein the optical sensors each comprise separate emitter and receiver pairs operatively arranged within the checkout location.

5. The apparatus of claim 2, wherein the finite state machine logic is implemented in a field programmable gate array.

6. The apparatus of claim 2, wherein the output signals are produced in a format S=(a, b, c), wherein "a" is an output signal generated when a chassis side-rail of the cart is detected, and "b" and "c" are output signals when a wheel of the cart is detected, and the activator signal is generated only after four output signals are decoded as follows: (1,0,0), (1,1,0), (1,0,0), and (1,0,1).

7. The apparatus of claim 6, wherein the activator signal is generated only after the four output signals are decoded in sequence.

8. The apparatus of claim 1, wherein the predetermined parts are a cart frame side rail and a cart front wheel.

9. The apparatus of claim 1, wherein the activator signal is generated only when the optical sensors detect the predetermined parts of the cart in a predetermined sequence.

10. The apparatus of claim 1, wherein the digital image is generated by use of structured illumination in which light energy of a predetermined direction, shape, temporality and wavelength is projected.

11. The apparatus of claim 1, wherein the optical line generator comprises a wide fan-angle, flat-beam, projecting laser.

12. The apparatus of claim 11, wherein the imager comprises an imager lens having an optical axis that is offset and angled relative to a projection axis of the laser so as to produce a parallax effect.

13. The apparatus of claim 12, further comprising an optical filter to filter all light entering the imager lens except for a wavelength emitted by the optical line generator.

14. The apparatus of claim 13, further comprising a strip of retro-reflective material operatively arranged in the checkout location to intensify the reflection of projected optical line.

15. The apparatus of claim 1, further comprising a system operatively connected to the cart for preventing movement of the cart away from the check-out location when the alarm signal is generated.

16. A method of detecting a cart used to bring items to a checkout location, and an item on a bottom tray of the cart, the method comprising the steps of:

(a) operatively arranging a plurality of optical sensors within the checkout location;

(b) detecting predetermined parts of the cart with the optical sensors and producing output signals dependent on the detected predetermined parts;

(c) decoding the output signals using electronic logic and generating an activator signal to activate an item detector that comprises an optical line generator, an imager and a pattern-recognition means;

(d) generating a digital image corresponding to the item detected on the bottom tray; and (e) processing and analyzing the digital image and generating the alarm signal when the item is detected.

17. The method of claim 16, comprising at least three optical sensors and wherein the predetermined parts detected by the optical sensors are a cart frame side rail and a cart front wheel.

18. The method of claim 17, wherein the activator signal is generated only when the optical sensors detect the predetermined parts of the cart in a predetermined sequence.

19. The method of claim 17, wherein the output signals are produced in a format S=(a, b, c) wherein "a" is an output signal generated when a chassis side-rail of the cart is detected, and "b" and "c" are output signals when a wheel of the cart is detected, and the activator signal is generated only after the four output signals are decoded as follows: (1, 0, 0), (1, 1, 0), (1, 0, 0), and (1, 0, 1).

20. The method of claim 19, wherein the activator signal is generated only after the four output signals are decoded in sequence.

21. The method of claim 16, further comprising the step of projecting light energy of a predetermined direction, shape, temporality and wavelength onto the bottom tray to create structured illumination to generate the digital image.

22. The method of claim 21, wherein the optical line generator and imager comprise a wide fan-angle, flat-beam, projecting laser that generates the light energy.

23. The method of claim 22, further comprising the step of providing an imager lens on the imager having an optical axis that is offset and angled relative to a projection axis of the laser so as to produce a parallax effect.

24. The method of claim 23, further comprising the step of filtering all light entering the imager lens except for the light energy.

25. The method of claim 16 further comprising the step of preventing movement of the cart away from the checkout location when the alarm signal is generated.

* * * * *